US005408939A

United States Patent [19]

Lechman

[11] Patent Number: 5,408,939

[45] Date of Patent: Apr. 25, 1995

[54] ADJUSTABLE MONITOR SUPPORT

[75] Inventor: John N. Lechman, Effingham, Ill.

[73] Assignee: Nova Manufacturing & Assembly, Inc., Effingham, Ill.

[21] Appl. No.: 135,103

[22] Filed: Oct. 12, 1993

Related U.S. Application Data

[63] Continuation-in-part of Ser. No. 24,196, Feb. 26, 1993, Pat. No. 5,290,099, which is a continuation-in-part of Ser. No. 907,193, Jun. 30, 1992, abandoned, which is a continuation-in-part of Ser. No. 693,392, Apr. 30, 1991, Pat. No. 5,125,727, which is a continuation-in-part of Ser. No. 595,864, Oct. 11, 1990, abandoned.

[51] Int. Cl.[6] ..... A47B 9/00

[52] U.S. Cl. ..... 108/107; 312/223.3; 312/208.1

[58] Field of Search ..... 312/7.2, 194, 196, 208.1, 312/223.3; 108/107, 109; 248/132, 133, 139

[56] References Cited

U.S. PATENT DOCUMENTS

| | | |
|---|---|---|
| Re. 34,266 | 6/1993 | Schairbaum . |
| 2,970,702 | 2/1961 | Maslow . |
| 3,021,185 | 2/1962 | Kowalczyk . |
| 4,590,866 | 5/1986 | Schairbaum . |
| 4,755,009 | 7/1988 | Price et al. . |
| 4,836,478 | 6/1989 | Sweere . |
| 5,071,204 | 12/1991 | Price et al. . |
| 5,087,010 | 2/1992 | Walters . |
| 5,125,727 | 6/1992 | Lechman et al. . |
| 5,290,099 | 3/1994 | Lechman . |

FOREIGN PATENT DOCUMENTS

| | | |
|---|---|---|
| 1106895 | 8/1981 | Canada . |
| 560631 | 4/1975 | Switzerland . |
| 659370 | 1/1987 | Switzerland . |

*Primary Examiner*—Kenneth J. Dorner
*Assistant Examiner*—Gerald A. Anderson
*Attorney, Agent, or Firm*—Olson & Hierl, Ltd.

[57] ABSTRACT

A self-supporting, stable support structure is disclosed for positioning and supporting a monitor and also optionally for supporting a slidable keyboard tray. The support structure is also adapted for association with, and for support of, a top platform member that includes a transparent portion. The support structure includes a monitor support shelf member, a pair of side supports which are each equipped with a U-configured unitary frame having a pair of legs and a cross member. A plurality of transversely extending, vertically spaced load bearable wire members extend between each pair of legs. Adjustable connector assemblies connect the shelf member with selected members of each side support. Optionally but preferably, each side support also includes a transverse cross bar which is configured to support a drawer slide in combination with an associated respective leg member; thus, the support structure can also support a horizontally slidable keyboard tray. The combination of the monitor support structure and the top platform member provides a useful work station.

14 Claims, 2 Drawing Sheets

ADJUSTABLE MONITOR SUPPORT

RELATED APPLICATION

This application is a continuation-in-part of U.S. patent application Ser. No. 024,196 filed Feb. 26, 1993, now U.S. Pat. No. 5,290,099 issued Mar. 1, 1994 which is a continuation-in-part of U.S. patent application Ser. No. 907,193 filed Jun. 30, 1992, now abandoned which is a continuation-in-part of U.S. Ser. No. 693,392 filed Apr. 30, 1991, now U.S. Pat. No. 5,125,727 issued Jun. 30, 1992, which is a continuation-in-part of U.S. patent application Ser. No. 595,864 filed Oct. 11, 1990, now abandoned.

FIELD OF THE INVENTION

This invention relates to an improved adjustable monitor support assembly for use in a modular environment or the like in association with a top platform member which includes a transparent portion through which a supported monitor can be viewed.

BACKGROUND OF THE INVENTION

A new and very useful type of adjustable underdesk monitor support assembly for a desk structure, computer work station structure or the like is provided in Lechman et al. U.S. Pat. No. 5,125,727 (issued Jun. 30, 1992) which permits a monitor so supported to be viewable through a transparent portion in the structure working platform. This type of monitor support assembly is well suited not only for use in free standing desks, computer work stations, and the like, but also for use in work stations that are incorporated into a modular environment (see, for example, Lechman et al. U.S. Ser. No. 778,333 filed Oct. 17, 1991) now U.S. Pat. No. 5,294,193 issued Mar. 15, 1994.

In a modular environment, wall and even floor surfaces of cubicle defining members are associatable where practical with functional furniture components. A common objective in a modular structure is to provide a maximized usable working area (volumetrically and also surface-area wise).

The modular desk structure provided in the aforementioned U.S. Ser. No. 778,333 (now U.S. Pat. No. 5,294,193) requires that the associated monitor support structure be cooperatively engaged with side, back and bottom members that are a part of a desk structure.

For reasons of cost efficiency and improved space utilization, it has been found that an improved adjustable monitor support structure is needed which avoids the need for associated desk members along side, back and bottom portions. Such a monitor support structure is provided in the aforementioned Lechman Ser. No. 024,196 (now U.S. Pat. No. 5,290,099).

However, the prior monitor support structures, though certainly very useful, have been found not to satisfy the market demand for a versatile self-configuring, geometrically stable combination of monitor support structure and slidable keyboard support tray which can either be suspended from the undersurface of a desk or work station horizontal working surface (for supported monitor screen user viewing through a window in this undersurface), or be floor supported beneath the window for the viewing of the screen.

According to the present invention, the monitor support structure of Ser. No. 024,196 (now U.S. Pat. No. 5,290,099) is altered and changed to provide a new monitor support structure that meets the foregoing market demand. The resulting versatile support structure does not detract from the principal advantages and features of the monitor support structure of Ser. No. 024,196 (now U.S. Pat. No. 5,290,099).

SUMMARY OF THE INVENTION

The present invention provides a self-supporting, stable combination structure for adjustable monitor support and optionally for a slidable keyboard tray support. This structure is adapted for use in a variety of environmental applications. Thus, this structure can be variously associated with a work station. For example, it can be free-standing, top supported from a desk or like horizontal working surface, floor supported beneath such working surface, side associated with a supporting wall, or some combination of such possible associations.

In one useful arrangement, this combination structure is also adapted for association with, and for support of, a top platform member that includes a transparent window portion. Such an association provides a novel and very useful work station that is adapted for use in a cubicle or other working area. Thus, the combination structure, or in association with such a top platform member, can additionally be associated with a back and/or side upright panel members, if desired, such as a conventional modular wall panel, a desk modesty panel or the like, thereby to stabilize further the combination structure against tipping, sliding or the like.

A particularly significant and useful feature of this combination structure is that, when top or side supported, it does not need to be floor engaging. Thus, even the side supports terminate in spaced relationship to the underlying floor surface.

Another particularly significant and useful feature of this combination structure is that it can be floor supported when positioned as desired beneath the transparent window portion of a top platform member. For floor support purposes, the combination structure is provided with a pair of U-configured leg brackets. The opposite ends of each leg bracket are adapted for floor engagement while the interconnecting bracket base portion is associated with the bottom edge portion of one of the structure side supports.

A monitor that is held by the combination structure can be viewed through the transparent window portion of the platform member; for example, by a worker (or user) who is seated adjacent to the front edge of the top platform member. The platform member can have various configurations.

The inventive combination structure is simple, reliable and sturdy. It requires no associated side, back, or bottom desk components, but can be associated with such components, if desired. Advantageously, this combination structure can be used not only in a modular use environment, but also in free-standing desk and work station structures, including retrofit applications, if desired.

The combination support assembly has a monitor supporting shelf member that is adjustably supported at each lateral side thereof by a different one of a pair of side supports. Each side support incorporates a U-configured frame with a pair of opposing side legs with a bottom located integrally leg interconnecting base cross member that is adapted to be in vertically spaced relationship to an underlying floor surface. A plurality of vertically spaced cross supports interconnect between the side legs of each U-configured frame. The upper end regions of the legs of each U-shaped frame is provided with an interconnecting cross bar. Each cross bar can be directly associated by conventional fastening means to the undersurface of a top platform member, desk or the like.

Optionally, but preferably, the combination support structure is additionally provided with a keyboard-supporting tray which is slidably horizontally movable from a storage position under a top platform member to an extended position projecting outwardly from the front edge of the platform member. This tray is supported by slides that are associated with each of the interconnecting cross bars.

The present invention can thus achieve a work station structure that comprises in combination the combination support structure, a top platform member with a transparent portion, and a pair of U-configured leg brackets for supporting the side supports. The combination is associatable if desired with a back wall member, and the combination preferably includes a slidable keyboard supporting tray. This work station structure is well adapted for use in a modular working area, in an office cubicle having adjacent wall regions that are defined by modular wall panels, or the like.

The combination support structure and an associated flat top platform member provide a safe, effective, and efficient unitary combination.

The combination of monitor support structure with optional slidable keyboard support tray is easy to assemble from a kit or the like. If desired, the assembled structure can be subsequently easily disassembled, relocated for use elsewhere, and reassembled.

The combination monitor support and slidable keyboard support structure can be bottom supported and associated with a window equipped flat top platform member which provides a maximal working surface area for a worker and which is well suited for use in modular and other types of use environments.

Other and further objects, aims, features, purposes, advantages, modifications, embodiments and the like will be apparent to those skilled in the art from the teachings of the present specification taken with the appended drawings and associated claims.

DETAILED DESCRIPTION

Figure 1:
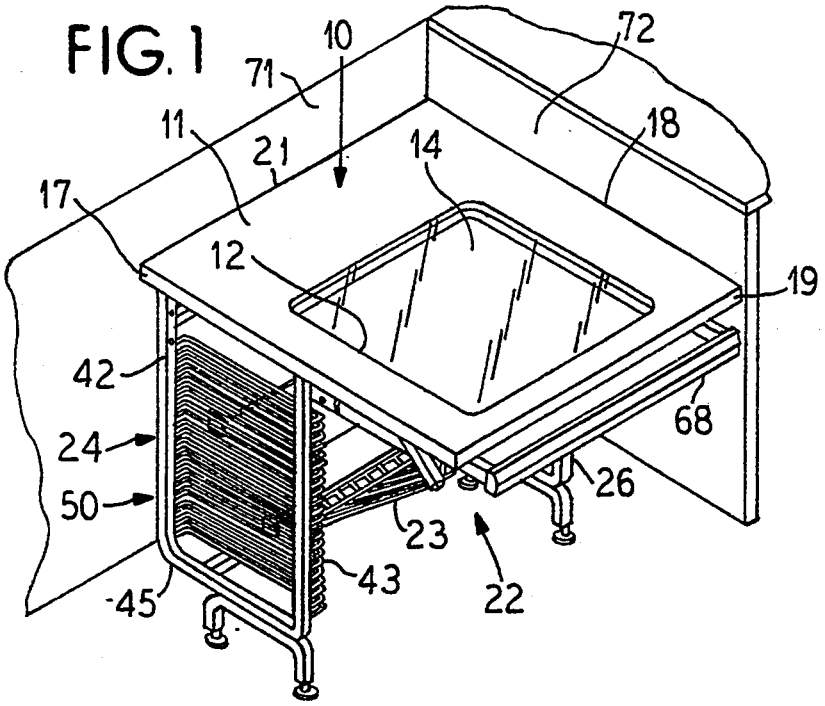
FIG. 1 is a perspective view of one embodiment of a monitor support structure of the present invention which is shown in illustrative combination with a flat top platform member, a keyboard-supporting slidable tray U-configured leg brackets, and a modular wall panel.
Figure 2:
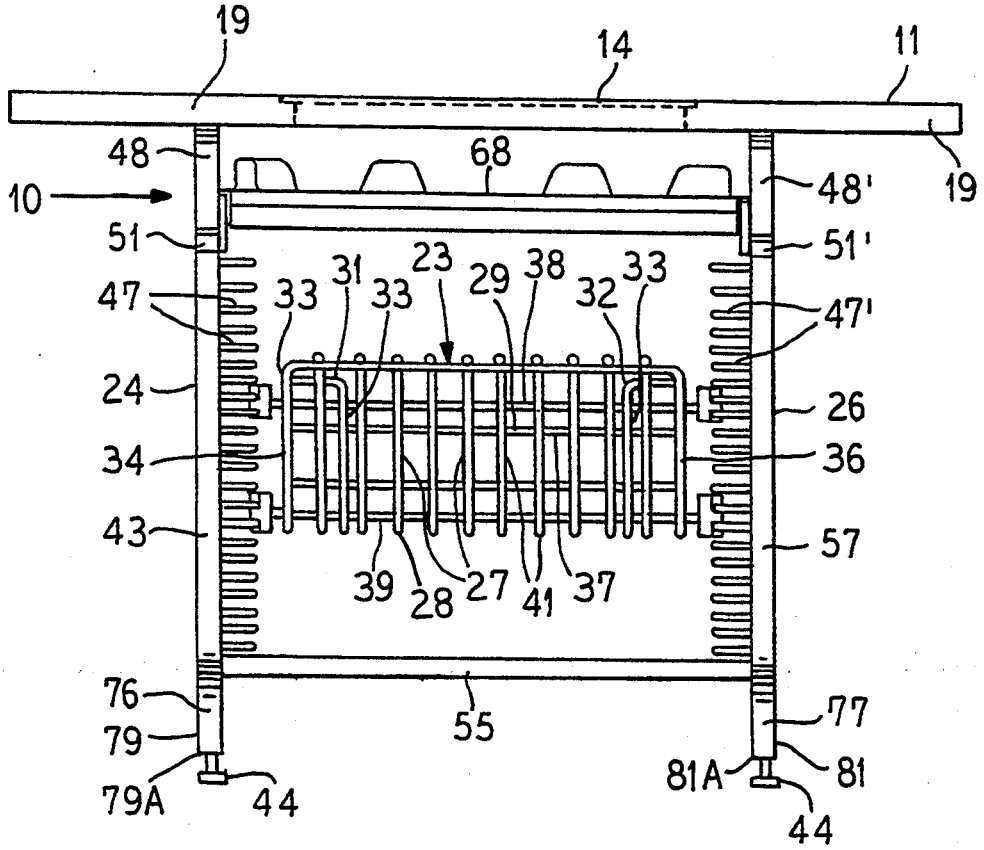
FIG. 2 is a front side elevational view of the embodiment shown in FIG. 1.
Figure 3:
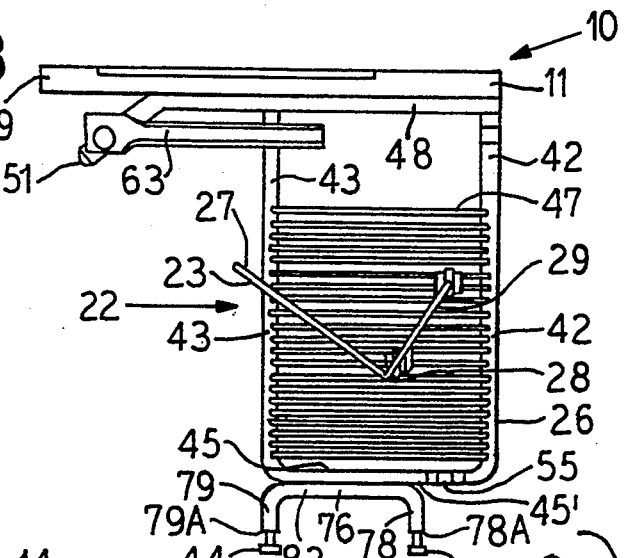
FIG. 3 is a right end elevational view of the embodiment shown in FIG. 1.
Figure 4:
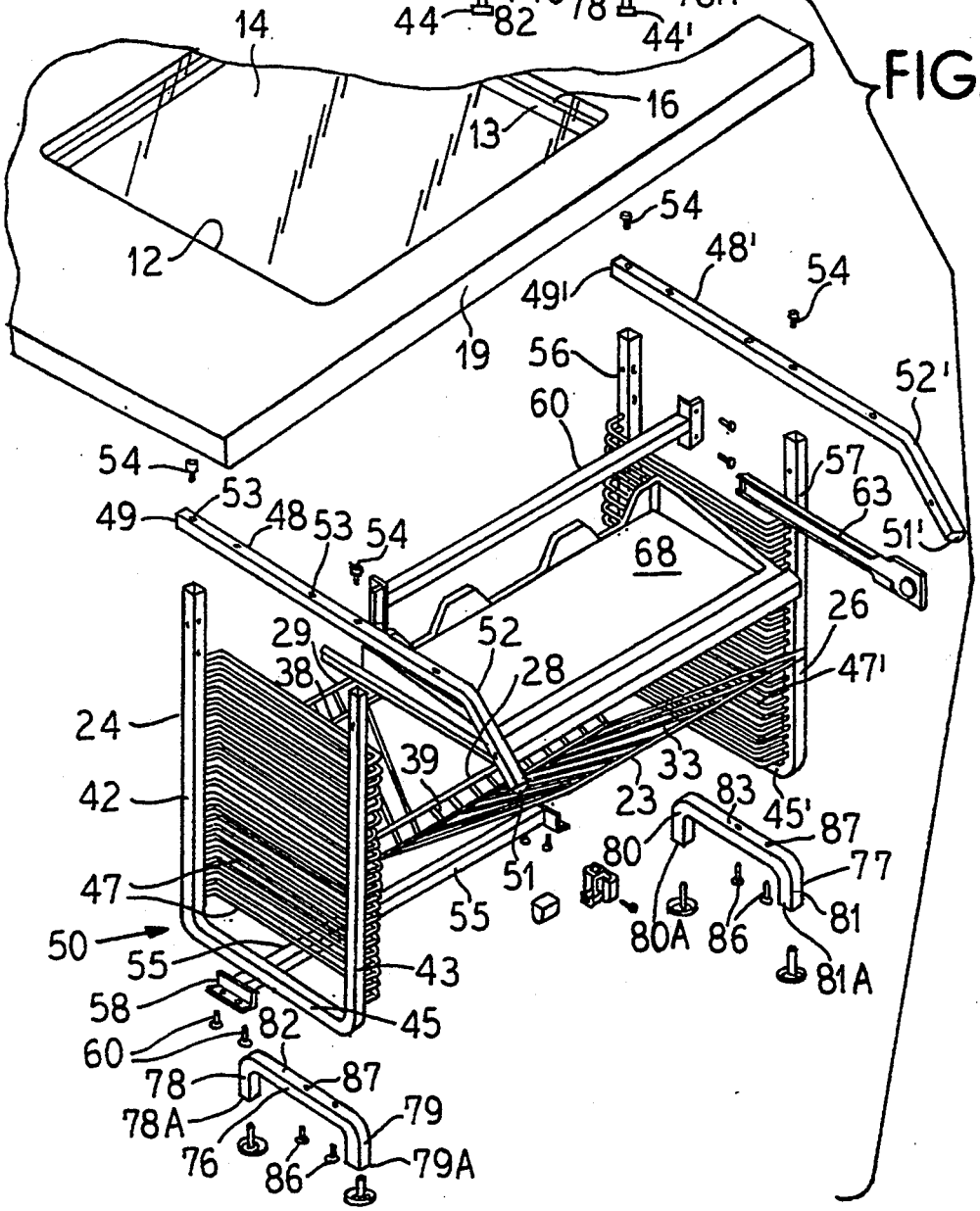
FIG. 4 is an exploded perspective view of the monitor support structure shown in FIG. 1.

Referring to FIGS. 1 through 4, there is seen an embodiment of a monitor support structure 10 of the present invention. The monitor support structure 10 is shown in supporting association with a top platform member 11 which is preferably rectangular or square configured, and generally horizontally extending.

The top platform member 11 is conveniently formed of a preferably thickened, dimensionally stable material, such as wood or wood based material, filled plastic, honeycomb molded plastic, formed sheet metal, a combination of materials, or the like. Use of wood or wood based or filled materials is presently preferred, such as plywood, particle board, fiber board, and the like, and a top platform member 11 so comprised of such a material is preferably conventionally laminated on its respective opposed outer faces to a layer comprised of a melamine polymer or the like. Exposed edge portions are preferably also similarly covered by such a laminate layer.

Top platform member 11 has an aperture 12 formed therein which preferably has appropriately beveled sides that are adapted to support and hold edge portions of a fitted transparent plate member 14 that is formed of clear glass or clear plastic (such as a polyacrylic resin or the like). Preferably, and as shown (see FIG. 4, for example), the lower portion of the side walls defining the aperture 12 are provided with an inwardly projecting flange 13 so that bottom edge adjacent portions peripherally about the transparent member 14 can rest upon a horizontal flat upper shoulder 16 of flange 13 with the upper portion of the sides of aperture 12 being perpendicular relative to shoulder 16. Aperture 12 is conveniently centrally formed in top platform member 11 relative to the lateral side edges 17 and 18 thereof, and is conveniently nearer to the front edge 19 thereof than to the back edge 21 thereof. Aperture 12 and plate member 14 are preferably generally square or rectangular in perimeter configuration and are preferably substantially larger in surface area than the surface area of the desired monitor screen that is to be supported by monitor support 10 and also viewed through plate member 14. Aperture 12 is located over a kneehole 22.

The monitor support assembly 10 incorporates a shelf member 23 upon which a monitor (not shown) can rest and a pair of side supports 24 and 26 which support the shelf member 23. The shelf member 23 has a flattened bottom support member 27 and, at an adjoining rear shelf edge 28, a flattened back support member 29 that integrally upstands or extends preferably perpendicularly from the edge 28.

The shelf member 23 can have various structures, but it is preferred that the shelf member 23 have an open grill or mesh-like structure so as to enhance heat dissipation from a monitor when in use. Suitable materials of construction for the shelf member 23 include sheet metal with vent holes, perforated sheet metal, expanded sheet metal, combinations of welded sheet metal with wire, wire with interwelded crossover locations, vented reinforced plastic, such as polyester platforms, and the like.

The shelf member 23 is, and as shown, preferably comprised of formed heavy wire members which are welded together at points of contact therebetween. Thus, shelf member 23 incorporates a perimeter defining wire 33 which is folded (bent) upwards at the rear shelf edge 28, and, at each opposed lateral upper back end edge 31 and 32, respectively, is also folded laterally inwardly (in opposed relationship) so as to provide added strength for the back member 29 by using two coplanar lengths of the wire 33 extending along each lateral opposed side edge 34 and 36 of shelf member 23. The interior lengths of wire 33 in back 29 extend from edges 31 and 32 downwardly around edge 28. Back member 29 is further provided in this embodiment with a pair of vertically spaced, parallel, longitudinally extending back member supporting wires 37 and also with a pair of vertically spaced, parallel, longitudinally extending shelf supporting wires 38 and 39.

The opposed respective ends and of each of wire 38 and wire 39 extend somewhat beyond the respective side edges 34 and 36 thereby to provide support stub shafts which extend laterally longitudinally outwardly from the back member 29 in respective opposed relationship to one another. The wire 38 is preferably adjacent to the upper back edges 31 and 32 and the wire 39 is preferably adjacent to the edge 28. Other locations for shelf supporting wires can be used, as those skilled in the art will appreciate, such as locations associated with the bottom support member 27, or with each of the bottom support member 27 and the back support member 29, or otherwise.

The space between the lateral side edges 34 and 36 in the region of the bottom support member 27 is supported by a plurality of laterally spaced, parallel, transversely extending bottom member support wires 41 which in the region of rear edge 28 are bent upwards and welded to at least one of the wires 37, or 39, thereby to aid in providing rigidity and support when the bottom member 27 is cantilevered from the back member 29 as the back member 29 is supported by stub shaft portions of wires 38 and 39.

The respective side supports 24 and 26 each extend vertically the full distance from contacting engagement with the adjacent portions of the underface of the top platform member 11 to a supporting floor surface (not shown).

Each side support 24 and 26 is similar to the other, except that support 26 is turned 180 degrees relative to support 24. The structure of support 24 is representative also of that of support 26. Support 24 incorporates a generally U-configured unitary frame 50 having a cross member 45 and a pair of transversely spaced, vertically extending leg members 42 and 43 that each upwardly extend from opposite ends of the cross member. The length of each leg 42 and 43 is equal to the other and this length extends from the floor to the undersurface of the platform 11. A plurality of vertically spaced transversely extending load bearing members 42 each comprised of heavy wire or the like. Each member 47 includes fastening means, such as butt weldments or the like, mounting each of its opposite end portions to a different one of the leg members. Each frame 50 is preferably cross-sectionally square and tubular.

Support 26 is similarly structured to support 24 and is provided with a cross member 45' and with vertically extending leg members 56 and 57.

The entire mid-region of side support 42 is thus preferably provided with a plurality of vertically equally spaced, parallel, horizontally oriented C-shaped heavy wires 47 with the butt weldments at each of their respective ends being located at the mid-region of a corresponding side face of each of legs 42 and 43. After the welding, which produces a ladder-like arrangement for the wires 47 relative to the legs 42 and 43, the wires 47 are preferably dipped or otherwise treated to coat each wire 47 with an electrically insulative, elastomeric polymeric coating, such as a vinyl plastisol or the like. Support 26 is similarly provided with wires 47'.

The shelf member 23 is adjustably connected to, and supported by, the side supports 24 and 26 by any convenient means. However, it is presently much preferred to associate each of the ends of the respective wires 38 and 39 with an adjacent pair of the wires 47 and 47' of the side supports 24 and 26, respectively, using a locking block assembly 64, such as is described in the aforereferenced U.S. Pat. No. 5,125,725 and in U.S. Ser. No. 906,837 filed Jun. 30, 1992.

Interiorly and across the top end of each leg 42 and 43, a nut (not shown) is secured by welding or the like. A cross bar 48 which is preferably cross-sectionally square and tubular like the frame 50 is laid across each of the top ends of the legs 42 and 43. Preferably (and as shown) the rear end 49 of the bar 48 is coincident with the back side of rear leg 42, and the forward end 51 of the bar 48 extends forwardly beyond the front leg 43 to a location which is preferably approximately just short of the anticipated forward edge 19 of the platform 11. At a location 52 that is in transversely rearwardly spaced relation to forward end 51 along the bar 48, the bar 48 is bent downwardly. The angle of this bend at location 52 can vary, but is typically and preferably in the range of about 25 degrees to about 50 degrees with a bend angle of about 30 degrees being presently most preferred. The bar 48 is provided with transverse bores 53 that are aligned with the upper end of each of the legs 42 and 43 so that screws 54 (preferably flat headed and mountable so as to be flush with the upper side of bar 48) can be threadably engaged through the bores 53 with the nuts in the top ends of legs 42 and 43, thereby to mount the bar 48 to each of the legs 42 and 43. Bar 48' of support 26 is similar to bar 48 and corresponding parts and features are similarly numbered, but with the addition of prime marks thereto, for identification purposes.

To join and hold the side supports 24 and 26 in a desired fixed laterally spaced relationship relative to one another, a horizontally oriented brace or cross support 55 is provided. Conveniently and preferably, brace 55 has a cross-sectionally square configuration like that of frame 50. Brace 55 is positioned in spaced, adjacent relationship to the underlying floor. Brace 55 preferably extends between the cross member 45 of side support 24 and the cross member 45' of side support 26. To achieve an abutting relationship between cross member 45 and adjacent portions of the brace 55 the opposite ends of brace 55 are provided with a vertical terminal plate 58 by welding or the like. Preferably, each plate 58 is angled, so that, through bores therethrough, each plate 58 is mounted to the adjacent cross members 45 and 45' by two screws 60 threadably engaged through mating tapped holes in each plate 58.

Preferably, a second brace 60 that is similar to brace 55 in structure is provided. Brace 60 preferably extends between rear leg 42 of support 24 and rear leg 56 of support 26 above the top most respective wires 47 and 47'.

Platform 11 is laid over the bars 48 and 48' of the respective side supports 24 and 26 and is fastened thereto by any convenient means. Conveniently and preferably screws (not shown) are extended vertically through bores (not detailed) in bars 48 and 48' respectively and are received in threaded engagement with the underside of platform 11.

The downturned forward end 51 and 51' of each crossbar 48 and 48' provides a forward mounting location for the forward end of each respective one of a pair of conventional fixed drawer slides 63. Each drawer slide 63 extends horizontally and transversely backwards from its associated ends 51 and 51' and into lateral abutting engagement with a side of individual legs 43 and 57, respectively. Screws (not detailed) that extend through aligned bores (not shown) in the slides 63 threadably engage with threaded mating holes in the respective crossbars 48 and 48' and in the legs 43 and 57 to complete this mounting of slides 63 in laterally spaced, parallel relationship to one another.

Under the top platform member 11 across the top portion of the kneehole 22, there is preferably located a transversely short keyboard holding or supporting platform or tray 68 that is transversely and horizontally slidable from the closed position shown in FIG. 1 to a fully extended position at which a keyboard (not shown) which rests upon the tray 68 is fully exposed and usable by a worker (not shown) seated before front edge 19 of platform member 11. The sliding capability for the tray 68 is achieved by mounting conventional rails (not detailed) on opposing sides of the tray 68 which rails matingly engage with the individual respective adjacent ones of the slides 63 and thereby provide the desired horizontal slidability for the tray 68. While various structures for the tray 68 can be employed, a presently preferred structure is shown and described in copending U.S. patent application Ser. No. 774,416 filed Oct. 10, 1991 (now U.S. Pat. No. 5,205,631 issued Apr. 27, 1993) (the relevant disclosure of which is incorporated herein by reference).

To avoid any tendency for the assembly of monitor support structure 10 and platform member 11 to tilt forwards, the platform member 11 and/or the monitor support structure 10 can be fastened to a vertical wall member, such as a back wall member 71 and/or a side wall member 72. The wall members 71 and 72 can be component panel portions of a conventional modular office structure. The fastening means can be conventional (such as brackets, screws, or the like, as desired). The assembly of monitor support structure 10 and platform member 11 is suitable for use as a work station in many different environments, such as in an environment where the central processing unit (or CPU, not shown), with which the monitor supported by the shelf member 23 and also the keyboard supported by the tray 68 are associated by wire and cable means (not shown), is remotely situated relative to the work station, and where a printer (not shown) is similarly remotely situated and associated.

The monitor support structure 10 is also suitable for association with a conventional desk structure, such as a desk structure which is being retrofitted with a top surface portion that includes a transparent window and with a monitor support structure of this invention for supporting a monitor beneath the window. In such an application, the monitor support structure of this invention can employed either without the bars 48 and 48', or with transversely shortened versions of the bars 48 and 48', whichever is preferred, as when the desk involved is already provided with a slidable tray that is to be used for keyboard support. The monitor support structure 10 is particularly advantageous and well suited for association with a desk structure when structure 10 incorporates the preferred form of the legs 42 and 43 in side support 24 and the legs 56 and 57 in side support 26 wherein each leg is equipped with an adjustable foot 44, 46, 44' and 46' respectively. Such leg height adjustability results in the structure 10 being suitable for use with desk structures having top platforms that vary in above floor height. Leg height adjustment is simply and readily achieved by changing the stem position of an adjustable foot relative to the leg bottom.

When the support assembly 10 is to be bottom supported by an underlying floor surface, the assembly 10 preferably and optionally incorporates a pair of U-configured leg brackets 76 and 77. Each of these leg brackets has a respective pair of spaced legs 78, 79, 80 and 81 (whose respective ends 78A, 79A, 80A and 81A are configured for floor surface engagement) and also an interconnecting base respective 82 and 83 member. Each leg bracket 76 and 77 is positioned adjacent the bottom portion of the cross member 45 and 45' of each side support 24 and 26. The cross members 45 and 45' are each associated with its adjacent leg bracket 76 and 77 by fastening means, such as screws 86 which are threadably received in the cross members 45 and 45' through bores 87 preformed in the bases 82 and 83. Thus, the respective side supports are floor supported by the leg brackets 76 and 77. The leg brackets 76 and 77 are particularly useful, for example, when the support assembly 10 is associated with a top member 11 or when the support assembly 10 cannot be associated with the bottom face of a desk top surface or plate member.

Optionally but preferably, the bottom of each leg 78 and 79, and 80 and 81 is interiorly fastened preferably by welding to a nut (not shown) into which the threaded stem of an adjustable foot 44 is threadably engaged so as to provide height adjustment and leveling adjustment capability for each such leg.

Various other embodiments, applications, features, alternative but equivalent structures and the like will be apparent to those skilled in the art from this description of the present invention and no undue limitations are to be drawn therefrom.

What is claimed is:

1. An adjustable support assembly for positioning and supporting a monitor under a transparent portion in a working platform comprising:

(a) a shelf member having a bottom support portion, a back support portion angularly extending from a rear region of said bottom support portion, lateral side portions, and a plurality of support members associated with said lateral side portions;

(b) a pair of side supports, each one being substantially vertically oriented, disposed in spaced, parallel relationship relative to the other thereof, and located along different respective one of said side portions;

(c) each one of said side supports comprising (1) a generally U-configured unitary frame having a cross member and a pair of transversely spaced vertically extending leg members that each extend upwardly from opposite ends of said cross member, (2) a plurality of vertically spaced, transversely extending load bearing members, each member including fastening means mounting each opposite end portion thereof to a different one of said leg members;

(d) first cross brace means connecting said cross members; and (e) means for adjustably connecting individual ones of said support members selectively to at least one of said load bearing members of each said side support so that said shelf member is vertically positionable, transversely translatable and tiltably adjustable relative to said side supports.

2. The support assembly of claim 1 which additionally incorporates a pair of U-configured leg brackets, each one of said leg brackets having a pair of spaced legs whose respective ends are configured for floor surface engagement and having an interconnecting base, each leg bracket being positioned adjacent a different one of said side supports so that said side support cross member is associatable with said leg bracket base, and including means for fastening each said leg bracket to said adjacent side support whereby said support assembly is supportable by said leg brackets.

3. The support assembly of claim 2 wherein each of said side supports and said leg brackets has a substantially square tubular configuration in cross section.

4. The assembly of claim 2 where each one said leg ends is associated with an adjustable foot means.

5. The support assembly of claim 1 wherein each one of said side supports additionally includes a generally horizontally extending top bar means which:

(a) extends transversely; and (b) is associated with an upper end portion of each one of said leg members and includes means for associating said top bar means with said leg members.

6. The support assembly of claim 5 wherein each one of said bar means projects forwardly beyond the forward one of said leg members of each said U-configured frame out over a kneehole region and includes a forward terminal downturned segment, thereby to provide a pair of laterally spaced forward downturned bar ends.

7. The support assembly of claim 6 wherein each one of said side supports additionally includes a stationary slide member that is mounted horizontally between said forward downturned end of said bar means and the transversely adjacent forward one of said leg members, and including means for mounting said stationary slide member to said bar means.

8. The support assembly of claim 7 wherein a keyboard supporting tray with a rail member horizontally mounted on each opposed lateral side thereof is provided, and each one of said rail members is slidably associated with an adjacent one of said stationary rails so that said tray is slidably extendable from a first position beneath said kneehole region and a second position that is outwardly extended from said first position.

9. The assembly of claim 8 wherein a top platform is positioned over said adjustable monitor support assembly and is supported by and is associated with each one of said bar means.

10. The support assembly of claim 1 wherein second cross brace means longitudinally extends between the upper end region of each rearward leg of said U-configured frame of each side support and including means for fastening each opposite end of said second cross brace means to a different one of said rearward legs with the rearward one of said leg members with the forward one of said leg members, including association means therefor.

11. The support assembly of claim 1 wherein each said adjustable connector means comprises a locking block assembly.

12. The assembly of claim 1 wherein a top platform is positioned over said adjustable monitor support assembly, and is supported by and is associated with each of said side supports.

13. A work station comprising a generally horizontal top platform that includes a transparent portion, and an adjustable monitor support assembly which supports said top platform, said support assembly comprising in combination:

(a) a shelf member having a bottom support portion, a back support portion angularly extending from a rear region of said bottom support portion, lateral side portions and a plurality of support members associated with said lateral sides;

(b) a pair of side supports, each one being vertically oriented, disposed in spaced, parallel relationship relative to the other thereof, and located along a different respective one of said sides;

(c) each one of said side supports comprising:

(1) generally U-configured unitary frame having a cross member and 1 pair of transversely spaced vertically extending leg members that each extend upwardly from opposite ends of said cross member, (2) a plurality of vertically spaced, transversely extending load bearing members, each member including fastening means mounting each opposite end portion thereof to a different one of said leg members.

(d) a pair of U-configured leg brackets, each one of said leg brackets having a pair of spaced legs whose respective ends are configured for floor surface engagement and having an interconnecting base, each leg bracket being positioned adjacent a different one of said side supports so that said side support cross member is associatable with said leg bracket base, and including means for fastening each said leg bracket to said adjacent side support whereby said support assembly is supportable by said leg brackets;

(e) cross brace means connecting said cross members; and (f) means for adjustably connecting individual ones of said support members selectively to at least one of said load bearing members of each said side support so that said shelf member is vertically positionable, transversely translatable and tiltably adjustable relative to said side supports.

14. The work station of claim 13 wherein the bottom each said leg member is associated with an adjustable foot means.

* * * * *

UNITED STATES PATENT AND TRADEMARK OFFICE

CERTIFICATE OF CORRECTION

PATENT NO. : 5,408,939
DATED : April 25, 1995
INVENTOR(S) : John N. Lechman

It is certified that error appears in the above-indentified patent and that said Letters Patent is hereby corrected as shown below:

In the Abstract, line 7, delete "member"; (per Amendment A)

In Column 9, Claim 10 should read:

--10. The support assembly of claim 1 wherein second cross brace means longitudinally extends between the upper end region of each rearward leg of said U-configured frame of each said side support and including means for fastening each opposite end of said second cross brace means to a different one of said rearward legs.-- (per Amendment Under 37 CFR 1.312)

Signed and Sealed this

Eleventh Day of June, 1996

*Attest:*

Bruce Lehman

BRUCE LEHMAN

*Attesting Officer*

*Commissioner of Patents and Trademarks*